US008245735B2

(12) United States Patent
Chase et al.

(10) Patent No.: US 8,245,735 B2
(45) Date of Patent: Aug. 21, 2012

(54) SELECT FILL SENSOR SYSTEM FOR REFRIGERATOR DISPENSERS

(75) Inventors: Kevin M. Chase, Saint Joseph, MI (US); Ronald L. Voglewede, Saint Joseph, MI (US); Jonathan C. Valentine, Saint Joseph, MI (US); Peter J. Richmond, Berrien Springs, MI (US); Randell L. Jeffery, Stevensville, MI (US); Martin P. Winik, Benton Harbor, MI (US); Tony L. Koenigsknecht, Royal Oak, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 998 days.

(21) Appl. No.: 12/017,118

(22) Filed: Jan. 21, 2008

(65) Prior Publication Data

US 2009/0183796 A1 Jul. 23, 2009

(51) Int. Cl.

| | |
|---|---|
| ***B65B 1/04*** | (2006.01) |
| ***B65B 57/02*** | (2006.01) |
| ***B65B 1/30*** | (2006.01) |
| ***F25B 49/00*** | (2006.01) |
| ***B67D 1/00*** | (2006.01) |

(52) U.S. Cl. ..... 141/1; 141/95; 141/141; 141/198; 141/351; 62/126; 222/1; 222/52

(58) Field of Classification Search ..... 141/1, 95, 141/141, 198, 351, 360; 62/126, 177, 389; 222/1, 52

See application file for complete search history.

(56) References Cited

U.S. PATENT DOCUMENTS

| | | | | |
|---|---|---|---|---|
| 3,937,362 | A | | 2/1976 | Salmijak et al. |
| 4,202,387 | A | | 5/1980 | Upton |
| 4,437,497 | A | | 3/1984 | Enander |
| 4,440,200 | A | * | 4/1984 | DeVale et al. ..... 141/95 |
| 4,446,896 | A | | 5/1984 | Campagna |
| 4,458,735 | A | | 7/1984 | Houman |
| 4,572,253 | A | | 2/1986 | Farmer et al. |
| 4,612,775 | A | * | 9/1986 | Branz et al. ..... 62/126 |
| 4,733,381 | A | | 3/1988 | Farmer et al. |
| 4,780,861 | A | | 10/1988 | Stembridge et al. |
| 4,798,232 | A | | 1/1989 | Stembridge et al. |
| 4,883,100 | A | | 11/1989 | Stembridge et al. |
| 4,890,651 | A | | 1/1990 | Stembridge et al. |

(Continued)

FOREIGN PATENT DOCUMENTS

JP 7067892 A 3/1995

*Primary Examiner* — Len Tran
*Assistant Examiner* — Ryan Reis
(74) *Attorney, Agent, or Firm* — Kirk W. Goodwin; Diederiks & Whitelaw PLC

(57) ABSTRACT

A refrigerator includes a dispenser having a dispenser well, a control for regulating a product dispensing operation, and a select fill sensor system for automatically initiating and terminating the dispensing operation. The sensor system includes a touch sensor mounted in the dispenser well and configured to sense the selection of a desired product level. A feedback array indicates the product level selected and tracks the product level within a container during the dispensing operation. The control automatically initiates a product dispensing operation based on the selection of a product level and the presence of the container in the dispenser well, and automatically terminates the dispensing operation when the product level in the container reaches the selected product level. In this manner, a hands-free dispenser is provided that can be utilized regardless of the shape or size of container utilized.

20 Claims, 3 Drawing Sheets

U.S. PATENT DOCUMENTS 4,917,155 A 4/1990 Koblasz et al.
4,944,335 A 7/1990 Stembridge et al.
4,961,456 A 10/1990 Stembridge et al.
5,017,909 A 5/1991 Goekler
5,036,892 A 8/1991 Stembridge et al.
5,129,548 A 7/1992 Wisniewski
5,490,547 A 2/1996 Abadi et al.
5,491,333 A 2/1996 Skell et al.
5,551,598 A * 9/1996 Cutsinger ..... 222/52
5,819,547 A 10/1998 Oh
6,082,419 A 7/2000 Skell et al.
6,227,265 B1 5/2001 Skell et al.
6,394,153 B2 * 5/2002 Skell et al. ..... 141/351
6,681,585 B1 1/2004 Stagg et al.
6,688,134 B2 2/2004 Barton et al.
6,705,356 B2 3/2004 Barton et al.
6,789,585 B1 * 9/2004 Janke ..... 141/198
6,912,870 B2 7/2005 Gnadinger
7,028,725 B2 * 4/2006 Hooker ..... 141/141
2005/0268624 A1 12/2005 Voglewede et al.
2005/0268639 A1 * 12/2005 Hortin et al. ..... 62/389
2006/0196212 A1 * 9/2006 Jenkins et al. ..... 62/340

* cited by examiner

SELECT FILL SENSOR SYSTEM FOR REFRIGERATOR DISPENSERS

BACKGROUND OF THE INVENTION

1. Field of the Invention

The present invention pertains to the art of refrigerators and, more particularly, to a sensor system employed in a dispenser mounted in a refrigerator door.

2. Description of the Related Art

Refrigerators having built-in ice/water dispensers are well known in the art. In general, the dispensers are mounted to a door of the refrigerator for the purpose of dispensing ice and/or water without requiring a user to access a refrigerator compartment. A typical dispenser includes a dispenser well into which a container is placed. Once the container is in position, an actuator is operated to release the ice and/or water into the container.

In many cases, the actuator is a pressure sensitive mechanical switch. Typically, the switch is operated by pushing the container against, for example, a lever. The lever, in turn, operates the switch that causes the ice and/or water to be dispensed. A number of dispensers employ multiple actuators, one for ice and another for water, while other dispensers employ a single actuator. Dispensers which employ a single actuator typically require additional control elements that enable a user to select between ice and water dispensing operations. Several manufacturers have converted from mechanical switches to electrical or membrane switches. Functioning in a similar manner, a container is pushed against the membrane switch to initiate the dispensing operation. Still other arrangements employ actuator buttons provided on a control panel of the dispenser. With this arrangement, the user continuously depresses a button to release ice and/or water into the container. In yet another arrangement, sensors are mounted in the dispenser well and function to sense a presence and size of the container. The dispenser automatically begins dispensing ice or water based on the presence of the container and stops dispensing before the container overfills. In this case, the level of liquid or ice dispensed is dependent on the container in this case, and cannot be altered by a consumer based on the amount of liquid or ice desired.

Over time, mechanical and membrane switches wear out. Physical interaction with the switches results in wear and tear on contact points, springs, levers and the like, which eventually require replacement. Another drawback with existing systems is the lack of an automatic cut-off feature. More specifically, once activated, the dispenser will discharge water or ice until the pressure is removed from the actuator. If the user is momentarily distracted or if the dispenser is operated by an inexperienced individual such as a child, the level of ice or water can overflow the container.

There also exist drawbacks with the systems that employ automatic actuators. Most active sensors cannot differentiate between a container and a child's hand. Thus, in such systems, the mere act of a child inserting a hand or other object into the dispenser well will initiate a dispensing operation. In addition, active sensors require both the sending and receiving of signals. Sensors of this type may require periodic alignment and necessitate the use of multiple components which further add to the overall cost and complexity of the appliance.

Therefore, despite the existence of refrigerator dispensers in the prior art, there still exists a need for an enhanced refrigerator dispensing system. More specifically, there exists a need for a refrigerator dispensing system that can be utilized regardless of the shape or size of the container to be filled, and that allows for a hands-free dispensing event.

SUMMARY OF THE INVENTION

The present invention is directed to a refrigerator including a cabinet within which is defined at least one refrigerated compartment. A door is pivotally mounted to the cabinet to provide access to the refrigerated compartment. A dispenser assembly is provided in the door to enable users to obtain ice and/or water without requiring access to the refrigerated compartment. The dispenser includes a main body portion, a control portion including a plurality of control elements for selecting a desired dispensing operation, a dispenser well provided in the main body portion, and a sensor system.

In accordance with the invention, the presence of a container within a dispenser well is sensed by a container recognition sensor. Additionally, a touch sensor is mounted in the dispenser well and is configured to sense the selection of a desired product level by a consumer. Initially, upon sensing the presence of a container in the dispenser well, a control illuminates a feedback array associated with the touch sensor, thereby prompting a user to select the desired product level. To select a fill level, a user simply touches the touch sensor strip at a level corresponding to the desired product level within the container. Upon selection of a desired product level, at least one of a plurality of light emitting diodes (LEDS) on the feedback array remain illuminated to indicate the selected fill level. After the presence of the container is detected and the product level is selected, a control initiates the product dispensing event, and product is dispensed into the container until the product level within the container reaches the corresponding selected product level indicated on the feedback array. A product level sensor is provided for continuously sensing the level of product dispensed into the container. In a preferred embodiment, the product level sensor is an ultrasonic sensor that also acts as the container recognition sensor. Also in the preferred embodiment, light emitting diodes in the feedback array are illuminated as the container is filled, thereby progressively illuminating successive ones of the plurality of vertically spaced light emitting diodes and allowing a user to track the progress of the dispensing event. With this system, a variable volume, hands-free product dispensing event is enabled, regardless of the volume or height of container utilized.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF PREFERRED EMBODIMENTS

Figure 1:
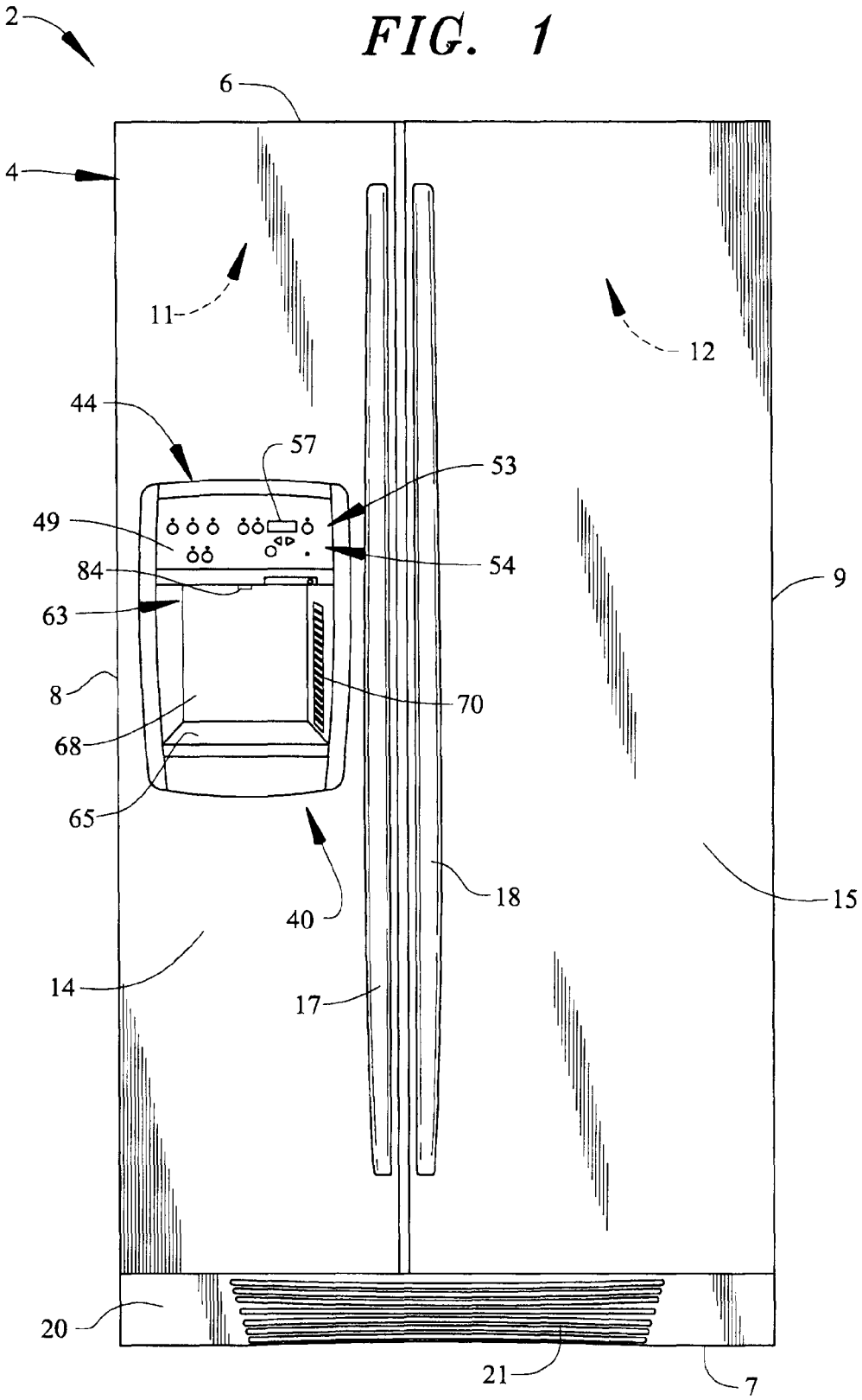
FIG. 1 is a front elevational view of a refrigerator incorporating a dispenser having a sensor system constructed in accordance with the present invention.

With initial reference to FIG. 1, a refrigerator constructed in accordance with the present invention is generally indicated at 2. Refrigerator 2 includes a cabinet 4 having a top wall 6, a bottom 7 and opposing side walls 8 and 9. In a manner known in the art, refrigerator 2 includes a freezer compartment 11 arranged along side a fresh food compartment 12. Freezer compartment 11 includes a corresponding freezer compartment door 14 and fresh food compartment 12 includes a corresponding fresh food compartment door 15. In a manner also known in the art, each door 14 and 15 includes an associated handle 17 and 18. Refrigerator 2 is also shown to include a kick plate 20 arranged at a bottom portion thereof having a vent 21 that permits air to flow to refrigeration components (not shown) that establish and maintain desired temperatures in freezer compartment 11 and fresh food compartment 12. In the embodiment shown, refrigerator 2 constitutes a side-by-side model. However, it should be understood that the present invention could also be employed in connection with a wide variety of refrigerators, including top mount, bottom mount, and French-style refrigerator models.

In accordance with the invention, refrigerator 2 includes a dispenser assembly 40 having a main housing 44 and a control panel 49. Control panel 49 includes first and second rows of control buttons 53 and 54 which enable a user to select various program parameters and operations. Control panel 49 further includes a display 57 which, in addition to functioning in cooperation with dispenser assembly 40, enables the user to select particular operational parameters for refrigerator 2, such as desired temperatures for freezer compartment 11 and fresh food compartment 12. Additionally, dispenser assembly 40 includes a dispenser well 63 having a base or container support portion 65 and a recessed, upstanding wall section 68.

Figure 2:
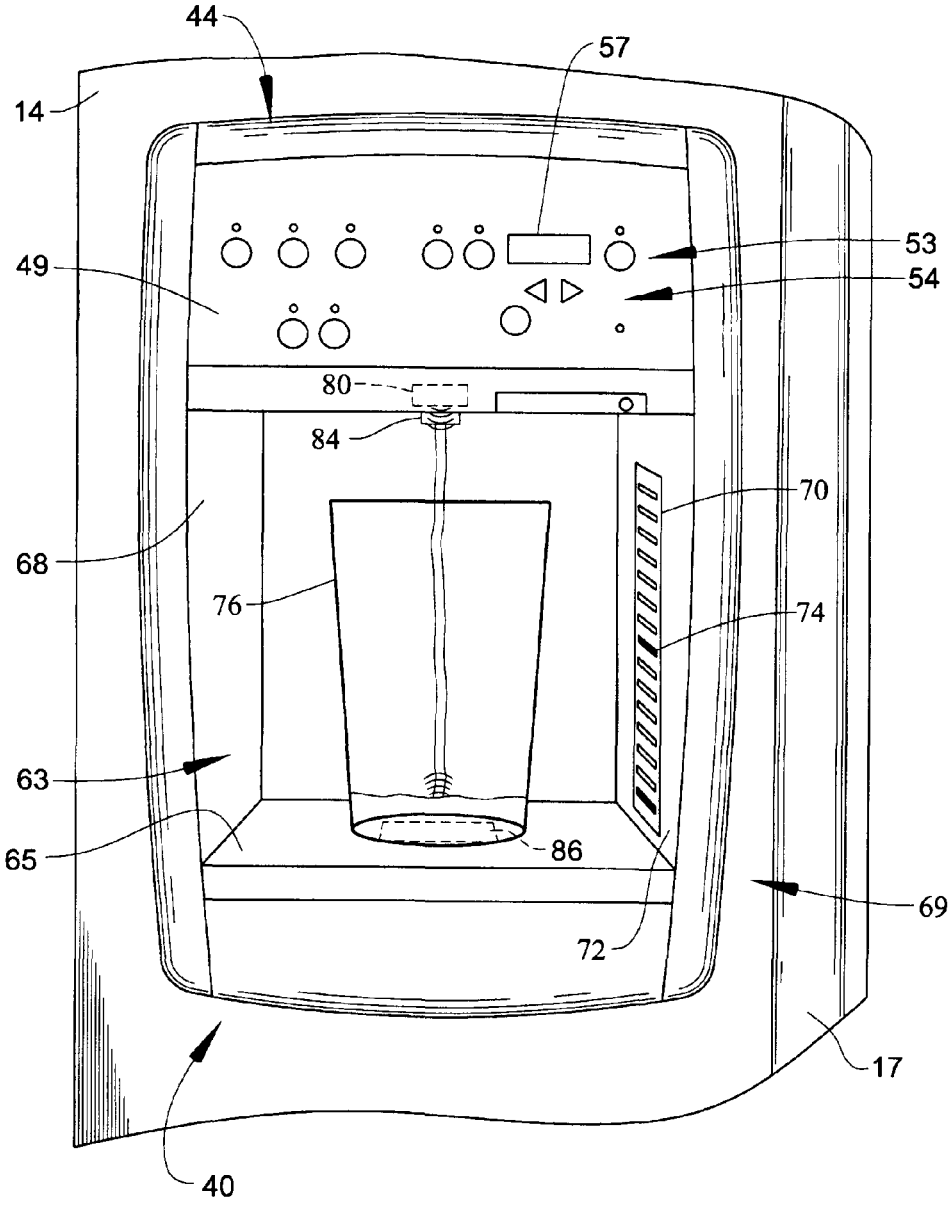
FIG. 2 is an enlarged view of the dispenser of FIG. 1 illustrating the beginning of a dispensing operation in accordance with the present invention.

Turning to FIG. 2, in accordance with the invention, dispenser assembly 40 includes a select fill sensor system of the present invention, which is generally indicated at 69, includes a means for selecting a product fill level, i.e., a touch sensor 70, preferably located on a side wall portion 72 of dispenser well 63, and a means for indicating the fill level, i.e., a feedback array 74. In the embodiment shown, feedback array 74 is in the form of a light emitting diode (LED) array extending vertically along side wall portion 72, although other feedback arrangements may be utilized, including a liquid crystal display (LCD) screen. Preferably, feedback array 74 extends substantially the entire height of upstanding wall section 68 so as to provide the optimal amount of fill level choices. Touch sensor 70 is preferably a capacitive-type sensor adapted to sense the touch of a user. However, it is also contemplated that electric field (E-field), inductive, infrared (IR), resistive, interactive LCD, membrane or push button sensors may be utilized. Regardless of the particular sensor, touch sensor 70 is utilized to select a desired level of a product (i.e., liquid or ice) dispensed within a container 76, as will be discussed in more detail below.

Figure 3:
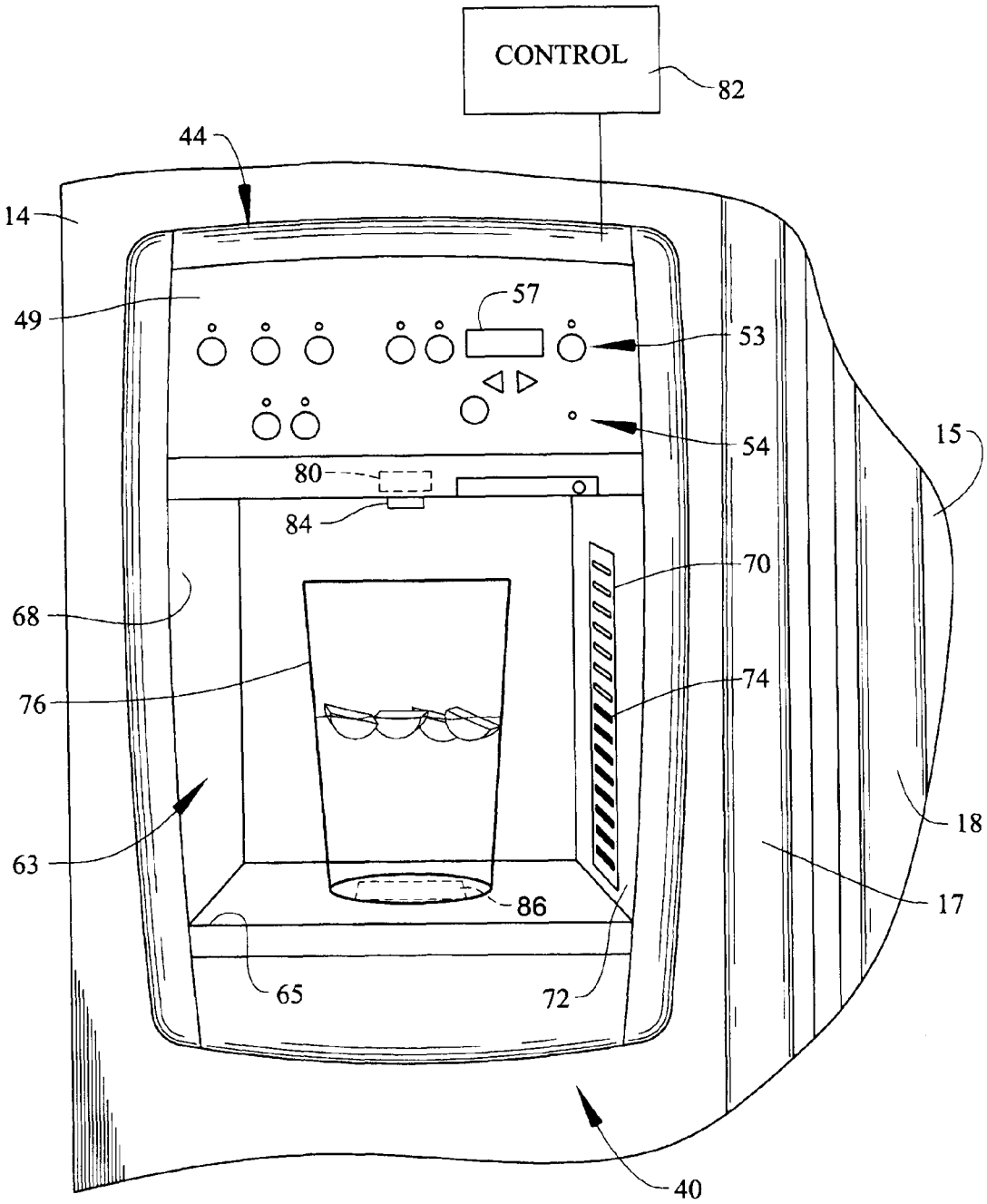
FIG. 3 is an enlarged view of the dispenser of FIG. 1 illustrating the end of a dispensing operation in accordance with the present invention.

In accordance with the present invention, sensor system 69 further comprises a means for sensing the level of ice and/or water within container 76, i.e., a product level sensor indicated at 80 in FIGS. 2 and 3. In the preferred embodiment, product level sensor 80 constitutes a top-mounted ultrasonic sensor adapted to continuously sense the level of water and/or ice within container 76. Alternatively, product level sensor 80 may comprise an image-mapping (camera) system, or a capacitive, IR or pressure/weight sensor arrangement. Sensor system 69 also includes a container recognition device adapted to sense the presence of container 76 within dispenser well 63. In accordance with one embodiment, the container recognition device comprises a weight or pressure sensor 86, but the container recognition device could be constituted by an ultrasonic sensor positioned at the side or behind container 76, an IR sensor positioned at the side of container 76, a retro-reflective IR sensor positioned at the top, side or back of container 76, a side or back capacitive sensor, an E-field sensor or a camera sensing system, for example. In an alternative embodiment, ultrasonic product level sensor 80 also functions to sense the presence of container 76 within dispenser well 63 such that a separate container recognition sensor 86 is not needed. Regardless, unlike prior art technologies which require sensing the height of a container, the present invention need only sense the presence of container 76 and may be utilized with containers having a variety of sizes and shapes.

In use, container recognition device 86 detects the presence of container 76 and feedback array 74 is illuminated, thereby prompting a user to select a desired product fill level. A consumer then makes a product fill level selection by touching touch sensor 70 at a height level corresponding with the desired fill level for container 76. The particular LED(s) associated with the selected fill level will remain illuminated, while the remaining LEDs will dim or be extinguished. In accordance with the most preferred form of the invention, control 82 automatically initiates a dispensing operation after container 76 is sensed and upon receipt of the product fill level selection. Control 82 will continue the dispensing of water from a spout 84 and/or ice through a chute (not shown) until product level sensor 80 detects that the fill level has reached the selected product level, at which point the dispensing operation is automatically terminated. In the most preferred embodiment of the invention, feedback array 74 tracks the product level within container 76. More specifically, as the product level in container 76 rises, the LEDs within feedback array 74 are illuminated to track the progress of the fill event as depicted in FIGS. 2 and 3.

Based on the above description, it should be readily apparent that dispenser assembly 40 of the present invention advantageously provides a hands-free method of filling a container with water and/or ice to a desired level, regardless of the particular size or shape of the container utilized and without the need for a user to calculate the volume of water and/or ice desired. Although described with reference to a preferred embodiment of the invention, it should be readily understood that various changes and/or modifications can be made to the invention without departing from the spirit thereof. For instance, although shown on the same side wall portion of the dispenser assembly, the feedback array and touch sensor may be located on different portions of the dispenser assembly. In addition, sensor system 69 may include overflow prevention, such as in the form of a software algorithm that utilizes the rate of water level change sensed by the product level sensor to determine when water and/or ice has begun to spill over the side of a container. Upon sensing an overflow event, sensor system 69 will automatically terminate the dispensing operation. Furthermore, it should be realized that the invention can be employed in connection with dispensing various liquid, e.g., water or flavored beverages, and ice, e.g., cubed, crushed or shaved, products. In general, the invention is only intended to be limited by the scope of the following claims.

What is claimed is:

1. A refrigerator comprising:

a cabinet;

at least one refrigerated compartment arranged within the cabinet;

a door mounted to the cabinet for selectively providing access to the at least one refrigerated compartment; and a dispenser assembly provided in the door for selectively releasing at least one of a liquid and ice to a consumer during a dispensing operation, said dispenser assembly including:

a main body portion;

a dispenser well provided in the main body portion, said dispenser well including a base section and an upstanding wall section;

a control for regulating the dispensing operation; and a select fill sensor system including a touch sensor adapted to be touched by a user at different height levels on the sensor to establish a corresponding desired product level, a feedback array adapted to indicate a product level to a user, and a product level sensor configured to detect a level of the at least one of the liquid and the ice released into a container during the dispensing operation, said control being linked to the select fill sensor system to automatically terminate the dispensing operation when the level of the at least one of the liquid and the ice reaches the desired product level.

2. The refrigerator according to claim 1, wherein the touch sensor is constituted by a capacitive sensor.

3. The refrigerator according to claim 1, wherein the sensor system further includes a container recognition sensor adapted to detect a presence of a container within the dispenser well, said control being adapted to automatically initiate a dispensing operation based on the presence of a container in the dispenser well and the desired product level.

4. The refrigerator according to claim 3, wherein the control is adapted to illuminate the feedback array upon detection of a container by the container recognition sensor.

5. The refrigerator according to claim 1, wherein the product level sensor is constituted by an ultrasonic sensor.

6. The refrigerator according to claim 5, wherein the ultrasonic sensor also constitutes a container recognition sensor adapted to detect a presence of a container within the dispenser well.

7. The refrigerator according to claim 1, wherein the touch sensor is located on the upstanding wall section of the dispenser well.

8. The refrigerator according to claim 7, wherein the feedback array is located on a side wall portion of the upstanding wall section of the dispenser well.

9. The refrigerator according to claim 1, wherein the feedback array comprises a plurality of spaced, light emitting diodes.

10. The refrigerator according to claim 9, wherein the control progressively illuminates successive ones of the plurality of light emitting diodes to track a progress of the dispensing operation.

11. The refrigerator according to claim 1, further comprising a control panel provided on the main body portion, said control panel including a plurality of control elements for selecting a desired operation.

12. A method of dispensing a product from a refrigerator mounted dispenser assembly including a dispenser well comprising:

sensing a presence of a container in the dispenser well;

sensing a touch of a consumer at a selected height level along a touch sensor, wherein the selected height level of the touch corresponds to a desired product level;

automatically initiating a dispensing operation by introducing a product into the container when the presence of the container in the dispenser well and the touch of the consumer to establish the desired product level are sensed; and sensing a product level during the dispensing operation.

13. The method of claim 12, further comprising:

prompting a user to select a desired product level by illuminating a feedback array upon sensing the presence of a container in the dispenser well.

14. The method of claim 13, further comprising:

illuminating only a portion of the feedback array associated with the desired product level upon sensing the touch of a consumer at the selected height level.

15. The method of claim 13, further comprising:

indicating a progress of the dispensing operation on the feedback array.

16. The method of claim 15, further comprising:

illuminating successive ones of a plurality of light emitting diodes to indicate the progress of the dispensing operation.

17. The method of claim 12, further comprising:

employing a common sensor to sense both the presence of a container and the product level during the dispensing operation.

18. The method of claim 12, further comprising:

automatically terminating the dispensing operation when the product level reaches the desired product level.

19. The method of claim 12, further comprising:

determining the occurrence of an overflow event of product from the container based on a rate of change of the product level sensed during the dispensing operation.

20. The method of claim 19, further comprising:

automatically terminating the dispensing operation upon determining that the overflow event has occurred.

* * * * *